US005137474A

United States Patent [19]

Lin

[11] Patent Number: 5,137,474

[45] Date of Patent: Aug. 11, 1992

[54] A.C. ELECTRICAL POWER SOCKET STRUCTURE

[76] Inventor: Chin C. Lin, No. 47, Alley 46, Lane 524, Hua Cheng Rd., Hsin Chuang City, Taiwan

[21] Appl. No.: 740,975

[22] Filed: Aug. 6, 1991

[51] Int. Cl.[5] ..... H01R 25/00

[52] U.S. Cl. ..... 439/650; 439/686

[58] Field of Search ..... 439/709-722, 439/724, 725, 752, 731, 685, 696, 701, 650, 686

[56] References Cited

U.S. PATENT DOCUMENTS 4,753,613 6/1988 Morgan ..... 439/752
4,959,023 9/1990 Watanabe et al. ..... 439/752
4,997,388 3/1991 Dale et al. ..... 439/752

*Primary Examiner*—David L. Pirlot
*Attorney, Agent, or Firm*—Bacon & Thomas

[57] ABSTRACT

An improved alternating current electrical socket structure includes a main enclosure in which are installed two lateral mounting blocks and one central mounting block; each mounting block has matching notch sections and tower sections, such that when the aforesaid lateral and central mounting blocks are aligned conductor strips can be positioned and securely held within the socket structure by the surfaces formed by the notch and tower sections of the lateral and central mounting blocks. The resulting configuration at the same time enables formed folds in the conductor strips to serve as tight receptacles in which the flat pins of an alternating current plug can be inserted tightly.

4 Claims, 2 Drawing Sheets

A.C. ELECTRICAL POWER SOCKET STRUCTURE

BACKGROUND OF THE INVENTION

The invention herein relates to an improved alternating current electrical socket structure which, even after repeated insertion therein of a conventional alternating current-type power plug, avoids the development of extreme temperature and consequent fire or other heat damage generated because of an increase in the quantity of electrical resistance between the alternating power plug pins and receptacles due to insufficient contact pressure. The invention also relates to an improved alternating current electrical socket structure offering the advantage of firm contact pressure for an extended period of usage.

It is commonly known that typical alternating current electrical sockets consist of two conductive strips which are formed so as to facilitate the insertion of an alternating current power plug. However, the conventional utilization of conductive strips alone leads to the deformation and therefore the deterioration of firm mechanical contact due to the widening of the pin insert distance between the conductive strips upon the repeated insertion and removal of the alternating current power plugs, ultimately developing into a situatuation in which the pins of the alternating current power plugs cannot be securely held. in such a conventional alternating current electrical socket, reinforcement springs are utilized to provide a tighter pin-holding insertion capability of the conductive strips. However, these metal springs are also subject to elastic fatigue and subsequent loosening following extended service, and furthermore are subject to corrosion, which is a factor contributing to a significant increase in electrical resistance and therefore the generation of heat during the process of conduction. The resulting high temperature may result in the outbreak of a fire or the softening of the enclosure structure, with the consequent distortion of the enclosure causing a decrease in tight pin-holding capabilities. This situation dangerously increases the possibility of extreme high-temperature electrical heat generation or even the attainment of a combustion point as the conductive strips fatigue or deteriorate in size, thereby compounding the shortening of the effective service life of the socket structure. In order to solve this problem, an improved alternating current power socket structure has been invented following extensive research by the inventor, in order to provide consumers with a far superior and safer alternative to the conventional electrical socket described above.

SUMMARY OF THE INVENTION

Therefore, the main objective of the invention herein is to provide an improved alternating current electrical power plug structure, the design of which resists the generation of heat due to inadequate conduction contact and which utilizes a conductive material with a high metallic hardness and durability so as to offer rigid mechanical properties when configured into the two conductive strips constituting the alternating current power plug pin receptacle components. The conductive strips are corrosion-resistant and thereby preclude the production of high-temperature heat which results in the embrittlement or lengthening of the conductive strips, causing the secure fastening characteristics of the conductive strips to be maintained in an excellent and intact condition.

DETAILED DESCRIPTION OF THE PREFERRED EMBODIMENT

Figure 1:
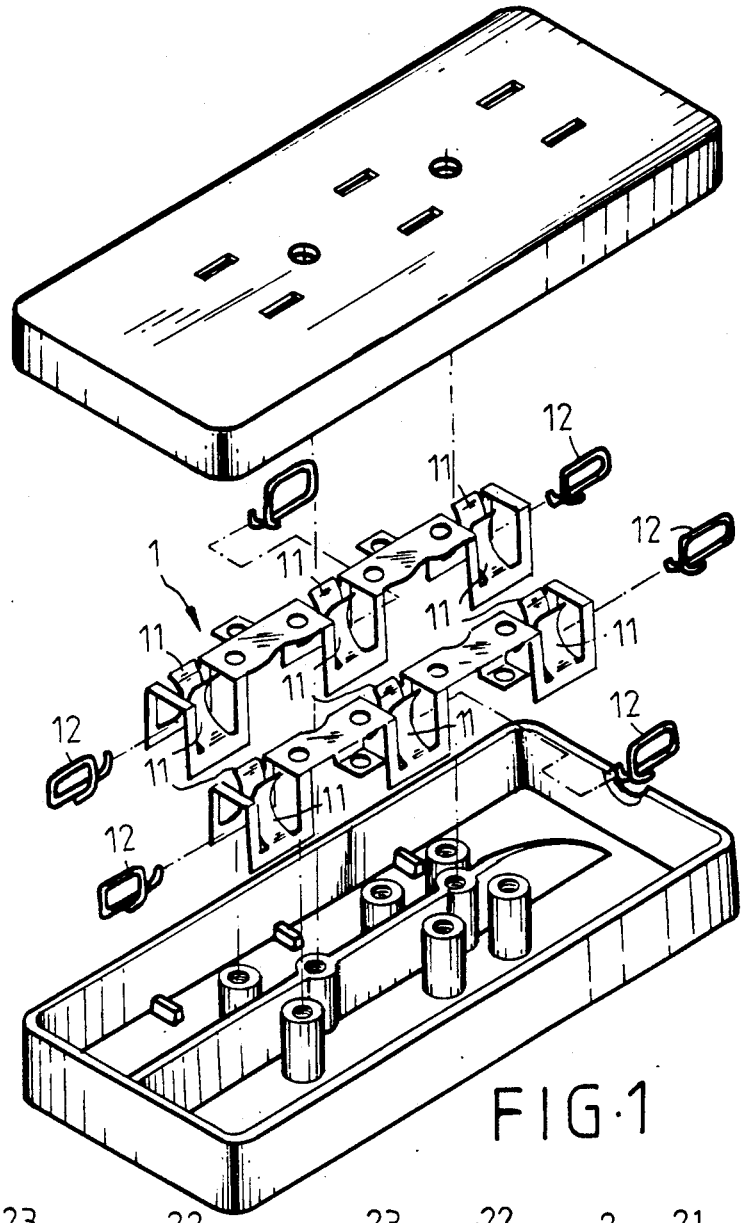
FIG. 1 is an exploded isometric drawing of a conventional alternating current power socket structure.

As illustrated in FIG. 1, a conventional alternating current power socket consists of two insertion folds (11) formed in each conductive strip (1) which are mounted within an enclosure in such a way that the aforesaid insertion folds (11) are oriented to the upper side of the enclosure to match the parallel entry slots which allow the insertion of the flat pins of alternating current power plugs. A reinforcement spring (12) is slid over each aforementioned insertion fold (11) to compensate for and prolong the inadequate two-way holding pressure of the insertion fold (11). However, each of the aforementioned reinforcement springs (12) is subject to cumulative fatigue which is manifested as a gradual loosening of original tension. Moreover, the reliance on tensile reinforcement is not very effective because the aforesaid reinforcement springs (12) are subject to extreme corrosion due to ambient atmospheric moisture and the electrolytic effect of high current conduction, with the result that such corrosion may spread to the contact surfaces of the insertion folds (11) and therefore raise the degree of electrical resistance. Consequently in the poorly conducted flow of electrical current will be converted into heat with a temperature high enough to scorch the adjacent area or combust into open flame. This result will radically shorten the service life of a conventional type of alternating current power socket or even result in the complete destruction of the device.

Figure 3:
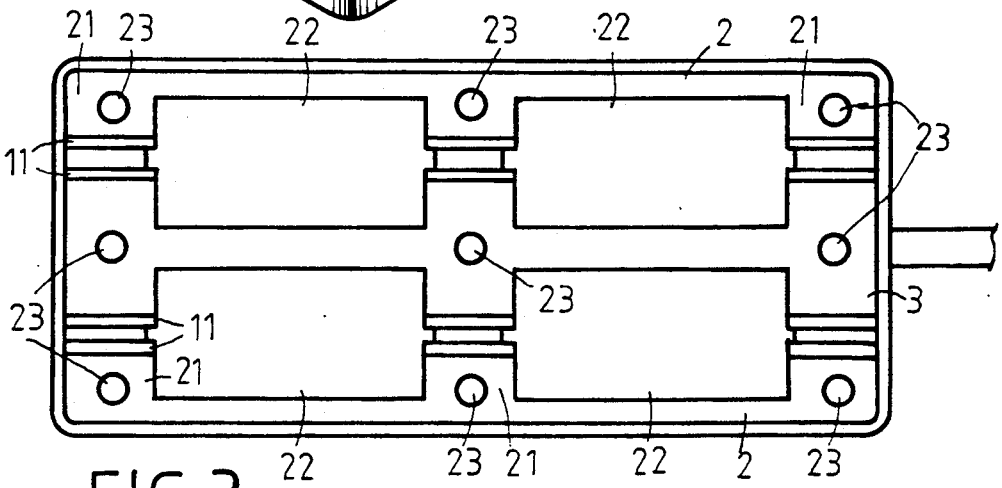
FIG. 3 is a drawing showing the top view of the improved alternating current power socket structure of the invention herein.
Figure 2:
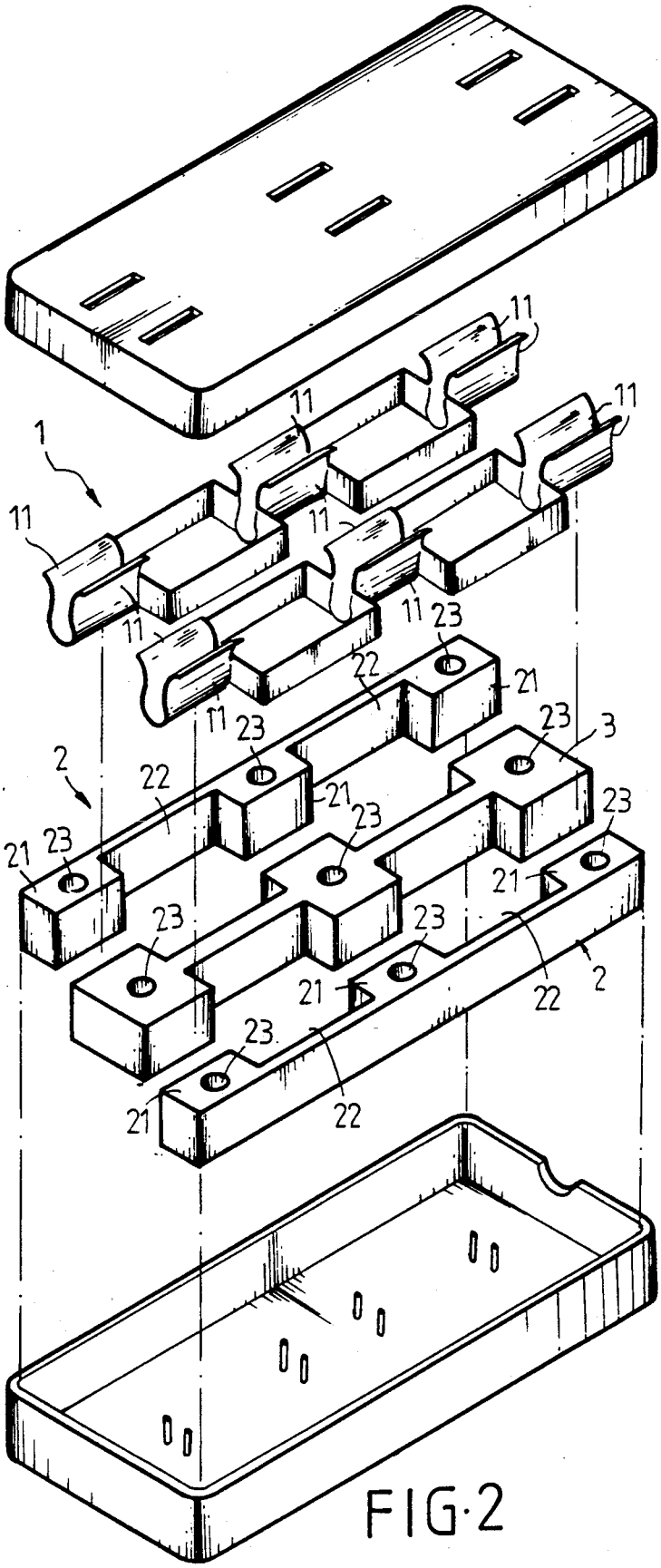
FIG. 2 is a detailed isometric drawing of the improved alternating current power socket structure of the invention herein.

The structural improvements that serve to thoroughly alleviate the hazardous potential described above are indicated in FIG. 2 and FIG. 3. The insertion folds (11) are formed out of strips made of an SIC-class rated durable metal that remains resilient to a maximum temperature of approximately 200 degrees centigrade. Moreover the lateral mounting blocks (2) and the central mounting block (3) are provided to securely wedge the insertion folds of the conductive strips (1) therebetween, as described below.

Thus, the improved alternating current power socket structure of the invention herein retains firm plug-pin insertion capabilities for an extended period of utilization because the inner sides of the aforementioned lateral mounting blocks (2) have tower sections (21) and notch sections (22), while the flat outer sides of the lateral mounting block (2) are positioned against the internal walls of the mounting enclosure. The aforementioned central mounting block (3) has notch sections which are congruent to and facing the notch sections (22) when positioned between the aforesaid lateral mounting blocks (2). Each lateral mounting block (2) and the central mounting block (3) is made out of an elastic solid material and is secured to the base of the enclosure through three fastener holes. When installed in the enclosure, the tower sections (2) of the lateral mounting blocks (2) firmly wedge the insertion folds (11) formed on the conductive strips (1) within a gap of predetermined width, with the congruent tower sections of the central mounting block (3) constituting the opposite end of the aforesaid gap. The tight fit so attained precludes the situation of loose electrical contact which leads to the generation of high-temperature and possible combustion and thereby increases the service life of the invention herein. Furthermore, the elastic properties of the aforementioned mounting blocks (2) (3) enable enhanced and efficient durability in terms of resistance to breaking due to repeated mechanical stress.

In summary, the ingenious design of the invention herein overcomes all of the common deficiencies found in conventional alternating current power sockets and which furthermore constitutes a vastly enhanced new product which is totally practical. Since no device identical to the invention has been observed in existence, the invention herein may be considered fully original in conception and structure and therefore qualifies for the awarding of patent rights as provided for by the law; in anticipation thereof, this document is submitted in application for the duly deserved legal patent rights which are defined by the appended claims.

What is claimed by the invention herein is:

1. An alternating current power socket, comprising:

an enclosure;

two elongated lateral mounting blocks having notches in one side of each block to form notch section and tower sections;

an elongated central mounting block having notches on two sides to form tower sections and notch sections which are congruent to respective tower and notch sections of said lateral mounting blocks, wherein said lateral mounting blocks and said central mounting blocks are positioned in said enclosure such that tower sections of the respective central and lateral mounting blocks are aligned with and face each other to form a gap between said tower sections;

two conductive strips, each strip including means in the form of folds for receiving dual pins of an alternating current power plug, wherein said folds are wedged in said gaps, each fold engaging on one side a tower section of the central mounting block and on the other side a tower section of the lateral mounting block, said strips being parallel to each other.

2. An alternating current power socket as claimed in claim 1, wherein said central mounting block and said lateral mounting blocks include means defining fastener holes for securing said mounting blocks so said enclosure.

3. An alternating current power socket as claimed in 1, wherein said lateral mounting blocks and said central mounting blocks are elastic.

4. An alternating current power socket as claimed in claim 3, wherein said lateral mounting blocks and said central mounting block are constructed of an SIC-class material.

* * * * *